US005664909A

United States Patent [19]

Lindgren et al.

[11] Patent Number: 5,664,909

[45] Date of Patent: Sep. 9, 1997

[54] ROAD ROLLER

[75] Inventors: Jörgen Lindgren, Karlskrona; Sven-Erik Samuelsson, Nättraby; Anders Thulin, Lyckeby, all of Sweden

[73] Assignee: Dynapac Heavy Equipment AB, Kariskrona, Sweden

[21] Appl. No.: 551,794

[22] Filed: Nov. 7, 1995

[30] Foreign Application Priority Data

Nov. 9, 1994 [SE] Sweden ..... 9403841

[51] Int. Cl.[6] ..... B60K 26/00; E01C 19/26

[52] U.S. Cl. ..... 404/122; 180/326; 180/329

[58] Field of Search ..... 404/117, 122, 404/125, 126, 127; 180/20, 326, 329

[56] References Cited

U.S. PATENT DOCUMENTS

| | | | |
|---|---|---|---|
| Re. 27,840 | 12/1973 | Kronholm . | |
| 3,347,558 | 10/1967 | Grimes et al. | 180/329 X |
| 3,901,617 | 8/1975 | Herbst . | |
| 4,505,356 | 3/1985 | Baier et al. . | |
| 4,610,567 | 9/1986 | Hosking | 404/127 X |
| 5,086,869 | 2/1992 | Newbery et al. | 180/329 |

FOREIGN PATENT DOCUMENTS

| | | | |
|---|---|---|---|
| 636746 | 2/1995 | European Pat. Off. | 404/117 |
| 2830660 | 2/1979 | Germany . | |
| 147381 | 4/1981 | Germany | 404/122 |
| 2038722 | 7/1980 | United Kingdom | 180/329 |

*Primary Examiner*—James Lisehora
*Attorney, Agent, or Firm*—Walter Ottesen

[57] ABSTRACT

The invention relates to a road roller primarily for compacting road surfacing materials such as asphalt. The road roller provides an ergonomic workplace for the operator in the cabin of the road roller and offers an unobstructed view of the rollers (4 and 12) and especially of the lateral edges (4*a* and 12*a*), respectively, thereof. This is of major importance when positioning the road roller on the surface to be compacted. This is achieved with an asymmetrical arrangement of the cabin; that is, one side of the cabin extends beyond the lateral edges (4*a* and 12*a*), and the operator's seat 6, with the steering wheel 7 and controls 8, is pivotally and laterally displaceable within the cabin.

8 Claims, 3 Drawing Sheets

ROAD ROLLER

BACKGROUND OF THE INVENTION

The invention relates to road rollers used primarily for compaction of asphalt surfacing materials on roads. More particularly, the invention relates to an apparatus providing an ergonomic workplace for the operator in the cabin of the road roller and an unobstructed view of the rollers of the road roller and especially of the lateral edges of the rollers. This view is of major importance when positioning the road roller on the surface to be compacted. Compaction of road surfacing materials is achieved by repeated passages back and forth over a stretch whose width is equal to or greater than the width of the roller of the road roller. It is therefore essential for the operator to have full control over the exact lateral position of the roller edges, especially in work next to curbs or other raised surface structures. This requires that the operator be able to position his head in the vertical plane defined by the lateral edges of the roller during travel of road roller in the forward or rearward direction.

Prior art road rollers with a cabin do not allow the operator to conveniently obtain the desired view of the edges of the rollers. This is because the cabin is not wider than the rollers so road surfaces can be compacted right next to vertical obstacles, such as curbstones or poles. The operator therefore has to lean out through one of the openable side cabin windows and is then no longer protected against external conditions (exhaust fumes, precipitation, wind, noise, et cetera) against which the cabin is intended to provide protection. The operator is also forced to assume a highly strenuous and uncomfortable body position. Despite these disadvantages, the operator still does not have a clear line of sight especially along the edge of the forward roller because the arms of the yoke of the forward and/or rearward roller partially blocks the operator's view.

SUMMARY OF THE INVENTION

The object of the invention is to provide a road roller wherein the aforementioned disadvantages are eliminated.

This is provided by equipping the road roller with an asymmetrical safety cabin giving the operator wearing a seat belt an unobstructed view, for example, of the right roller edges, when viewed in the direction of travel from inside the cabin. This is achieved when the cabin has sufficient width to the right, without projecting beyond the roller edges to the left to permit compaction with the left side of the roller of the road surface adjacent to vertical obstacles. In addition, at least the front roller arms of the yoke holding the roller are positioned to have a rearward tilt to keep the yoke arms from blocking the line of sight of the operator along the edge of the front roller. A prerequisite for achieving an ergonomically sound cabin interior, especially with wide road rollers, is that the operator's seat and controls can be swivelled and laterally moved enough to permit a comfortable work position during operation of the road roller in the forward direction and in the rearward direction.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
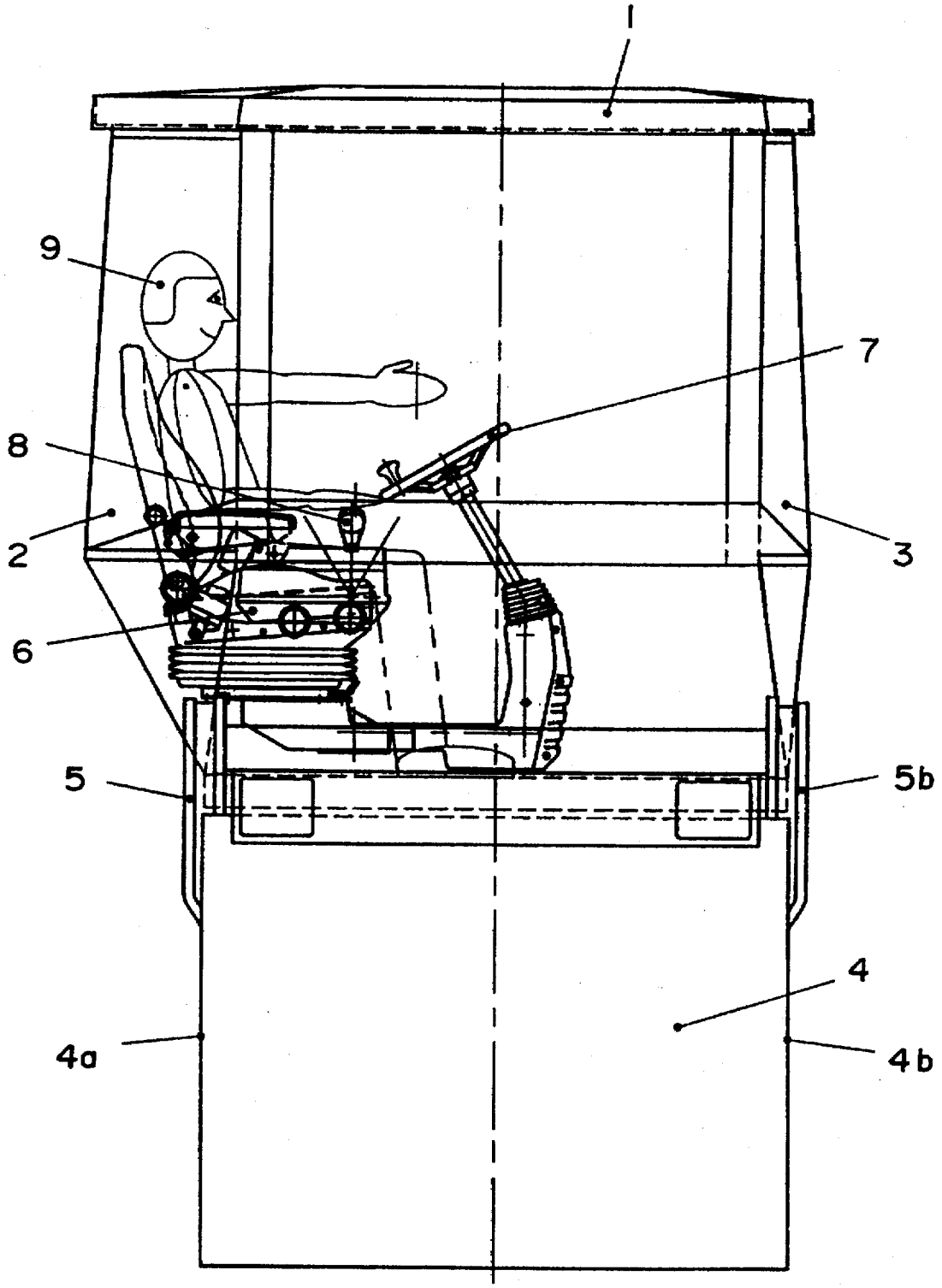
FIG. 1 is a front elevation view of an embodiment of the road roller of the invention having an asymmetrically arranged cabin.

FIG. 1 shows the asymmetrical safety cabin 1 of the road roller with the section 2 thereof to the right, as seen in the direction of travel from the position of the operator. The section 2 projects beyond the right outer edge 4*a* of the front roller 4. Here, the left part 3 of the cabin does not project beyond the outer edge of the left roller arm 5*b* of a roller yoke 5. The front roller 4 is rotatably journalled in arms 5*a* and 5*b* of the yoke 5. The pivotally and laterally displaceable operator's seat assembly 6, into whose frame the steering wheel 7 and controls 8 are integrated, is shown in its right position (as seen by the operator 9), giving the operator an unobstructed view along the edge 4*a* of the roller. The operator's seat 6 is also equipped with a seat belt (not shown), and the cabin is equipped with rollover protection; that is, the cabin is devised and attached to the frame of the road roller in such a way that it protects the operator if the road roller should overturn.

Figure 2:
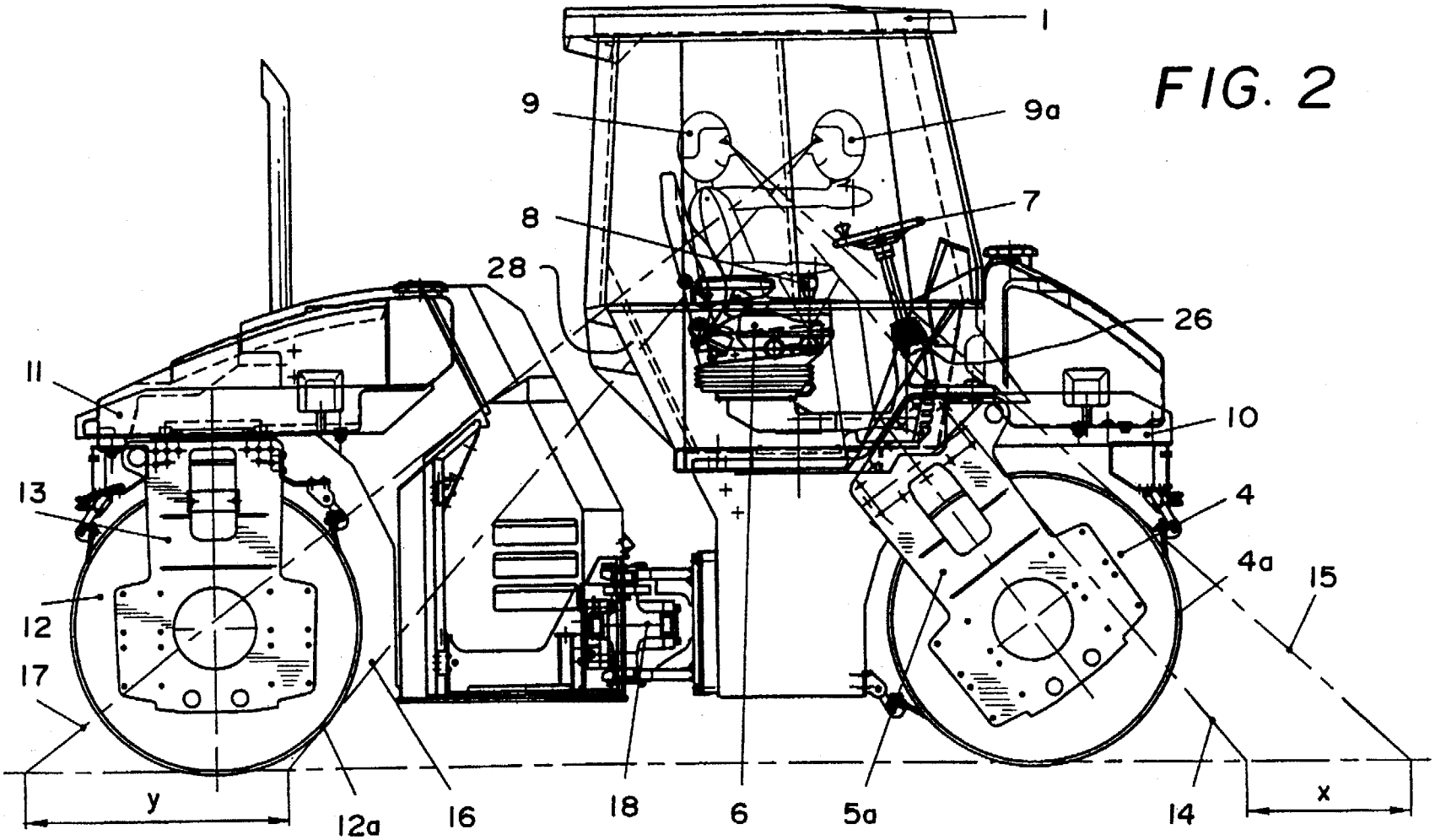
FIG. 2 is a side elevation view of the road roller shown in FIG. 1.

FIG. 2 shows the road roller from the side with its front roller 4 and rear roller 12. The front roller 4 is rigidly attached to the frame 10 via roller yoke 5 and the rear roller 12 is rotatably connected to a frame section 11 via the roller yoke 13.

The frame sections 10 and 11 are interconnected with a frame steering joint 18. The front frame section 10 is equipped with the asymmetrical safety cabin 1 in which the pivotally and laterally displaceable driving seat 6, with the integrated steering wheel 7 and controls 8, is located. The operator's lines of sight along the edge of the front roller are identified by 14 and 15, and the ground area visible beyond the roller edge 4*a* during forward operation is indicated by (x). In a corresponding manner and for operation to the rear, the ground area (y) is visible within the lines of sight 16 and 17 beyond the edge 12*a* of the rear roller.

Figure 3:
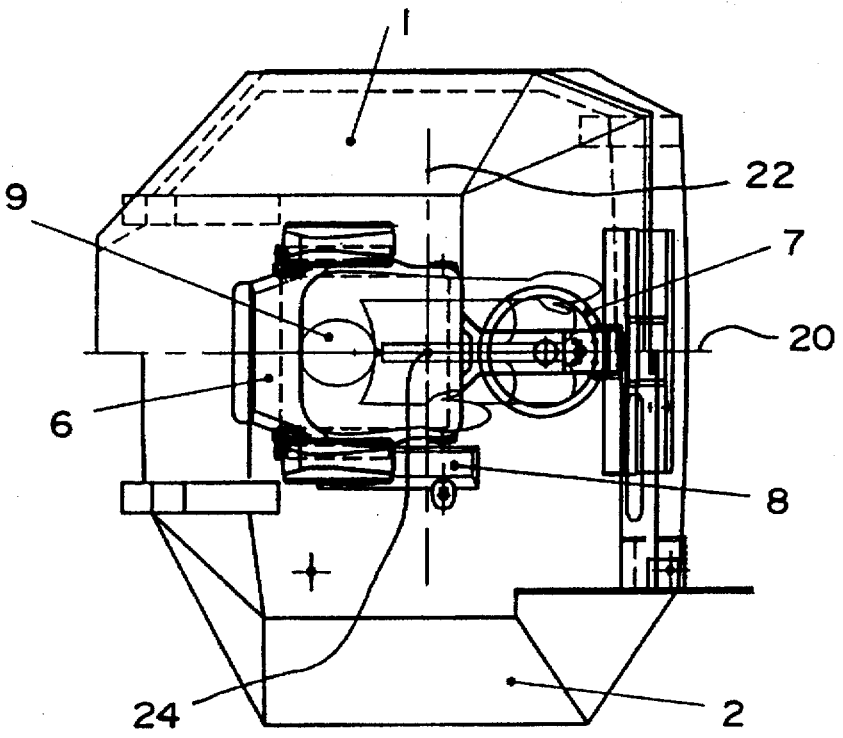
FIG. 3 is a plan view of the cabin interior with the operator's seat assembly centrally positioned for forward operation of the road roller; and, FIG. 4 is a plan view of the cabin interior with the operator's seat assembly being pivotally and displaceably movable to give the operator an unobstructed view of the right edges of the roller during forward operation of the road roller.

FIG. 3 shows a plan view of the cabin 1 with the operator's seat 6 centrally placed in relation to the longitudinal center axis 20 of the road roller and pointing straight ahead in the forward direction. The steering wheel 7 and controls 8 are integrated into the seat assembly occupied by the operator 9. The asymmetrical part 2 of the cabin projects outwardly to the right.

The operator's seat is mounted on a slide or the like represented schematically by line 22 so that the entire seat assembly (seat, steering wheel and controls) can be moved as a unit in translation by the operator within the cabin from left to right. The pivot pin 24 on the slide permits the operator to pivot the seat assembly thereby combining pivotal and translatory movements within the cabin. The operator's seat assembly is also displaceable in the forward and rearward directions along axis 20. The operator's seat assembly is further equipped with a first lever 30 which is actuated by the operator to release or lock the slide and is always locked when not actuated by the operator. A second lever 32 releases or locks the pivoting movement and can be left in the released or locked position by the operator.

Windows having a shape corresponding to an inverted triangle are provided in the cabin 1 at reference numerals 26 and 28 (FIG. 2) to permit the operator to view within the viewing angles defined by sight line pairs (14, 15) and (16, 17) (FIG. 2).

Figure 4:
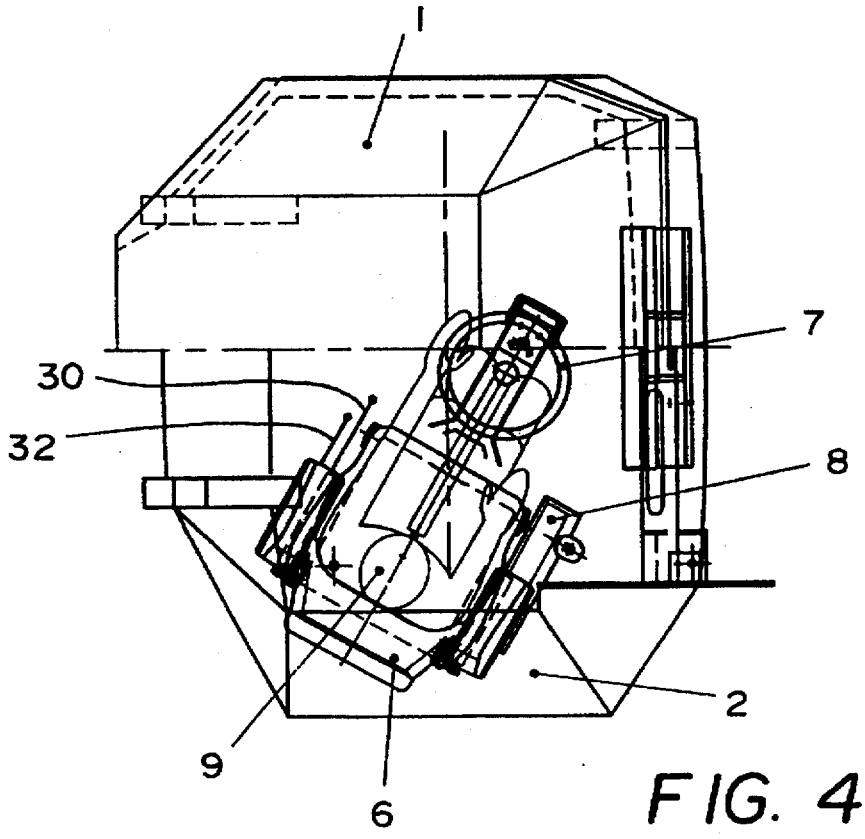

FIG. 4 shows the location of the operator's seat 6, with the wheel 7 and controls 8, giving the operator 9 an unobstructed view of the ground along the right edge 4*a* of the front roller 4 through window 26 in the asymmetrical part 2 of the cabin 1.

It is understood that the foregoing description is that of the preferred embodiments of the invention and that various changes and modifications may be made thereto without departing from the spirit and scope of the invention as defined in the appended claims.

What is claimed is:

1. A road roller for compacting road surfacing materials such as asphalt, the road roller comprising:

a chassis defining a longitudinal center axis;

a forward roller assembly and a rearward roller assembly both connected to said chassis;

said forward roller assembly including a forward yoke having two forward arms and a forward roller rotatably journalled in said forward arms;

said rearward roller assembly including a rearward yoke having two rearward arms and a rearward roller rotatably journalled in said rearward arms;

said forward roller having first and second forward lateral edges and said rearward roller having first and second rearward lateral edges;

said first forward lateral edge of said forward roller being at a first distance measured from said axis;

a cabin mounted on said chassis to accommodate an operator of said road roller;

said cabin having first and second side walls;

said cabin having a window formed therein close to said first side wall to permit viewing by the operator of said forward roller from within said cabin; and, said cabin being mounted on said chassis to place said first side wall at a second distance from said axis greater than said first distance to define an outboard region inside said cabin between said first and second distances;

a seat assembly equipped with a seat for accommodating the operator within said cabin;

means for mounting said seat assembly in said cabin to allow a movement of said seat assembly within said cabin to permit said seat assembly to be moved into said outboard region thereby permitting the operator to have a clear unobstructed view through said window of said forward roller along said first lateral edge thereof.

2. The road roller of claim 1, wherein said cabin is mounted on said chassis so that said second side wall is not located at a lateral distance from said axis farther than said second forward lateral edge of said forward roller.

3. The road roller of claim 2, said forward arms being tilted toward said cabin so as to cause said forward arms to extend in a direction substantially parallel to the line of sight of said operator looking at said forward roller from within said cabin.

4. A road roller for compacting road surfacing materials such as asphalt, the road roller comprising:

a chassis defining a longitudinal center axis;

a forward roller assembly and a rearward roller assembly both connected to said chassis;

said forward roller assembly including a forward yoke having two forward arms and a forward roller rotatably journalled in said forward arms;

said rearward roller assembly including a rearward yoke having two rearward arms and a rearward roller rotatably journalled in said rearward arms;

said forward roller having first and second forward lateral edges and said rearward roller having first and second rearward lateral edges;

said first forward lateral edge of said forward roller being at a first distance measured from said axis;

a cabin mounted on said chassis to accommodate an operator of said road roller;

said cabin having first and second side walls;

said cabin having a window formed therein close to said first side wall to permit viewing by the operator of said forward roller from within said cabin;

said cabin being mounted on said chassis to place said first side wall at a second distance from said axis greater than said first distance thereby permitting the operator to have a clear unobstructed view through said window of said forward roller along said first lateral edge thereof;

said forward arms being tilted toward said cabin so as to cause said forward arms to extend in a direction substantially parallel to the line of sight of said viewer looking at said forward roller from within said cabin;

a seat assembly equipped with a seat and controls for operating said road roller disposed in said cabin;

said window being a first window and said cabin having a second window formed therein also close to said first side wall to permit viewing by the operator of said rearward roller from within said cabin; and, means for mounting said seat assembly in said cabin to allow both a swivel movement about a vertical axis and a translational movement of said seat assembly within said cabin to permit the operator to move said seat assembly to have a clear unobstructed view through said second window of said rearward roller along said first rearward lateral edge thereof.

5. A road roller for compacting road surfacing materials such as asphalt, the road roller comprising:

a chassis defining a longitudinal center axis;

a forward roller assembly and a rearward roller assembly both connected to said chassis;

said forward roller assembly including a forward yoke having two forward arms and a forward roller rotatably journalled in said forward arms;

said rearward roller assembly including a rearward yoke having two rearward arms and a rearward roller rotatably journalled in said rearward arms;

said forward roller having first and second forward lateral edges and said rearward roller having first and second rearward lateral edges;

said first forward lateral edge of said forward roller being at a first distance measured from said axis;

a cabin mounted on said chassis to accommodate an operator of said road roller;

said cabin having first and second side walls;

said cabin being mounted on said chassis to place said first side wall at a second distance from said axis greater than said first distance to define an outboard region of said cabin between said first and second distances;

a seat assembly mounted in said cabin and including a seat for accommodating the operator in said outboard region;

said cabin having a window formed therein close to said first side wall; and, said window being in a plane transverse to said longitudinal axis and delimiting a portion of said outboard region thereby permitting the operator to have a clear unobstructed view through said window of said forward roller along said first lateral edge thereof.

6. The road roller of claim 5, further comprising:

said seat assembly being equipped with controls for operating said road roller disposed in said cabin;

said window being a first window and said cabin having a second window formed therein also close to said first side wall and in a second plane transverse to said longitudinal axis to permit viewing by the operator of said rearward roller from within said cabin; and, means for mounting said seat assembly in said cabin to allow both a swivel movement about a vertical axis and a translational movement of said seat assembly within said cabin to permit the operator to move said seat assembly to have a clear unobstructed view through said second window of said rearward roller along said first rearward lateral edge thereof.

7. The road roller of claim 5, wherein said cabin is mounted on said chassis so that said second side wall is not located at a lateral distance from said axis farther than said second forward lateral edge of said forward roller.

8. The road roller of claim 5, said forward arms being tilted toward said cabin so as to cause said forward arms to extend in a direction substantially parallel to the line of sight of said operator looking at said forward roller from within said cabin.

* * * * *